US008453758B2

(12) United States Patent
Horton, III et al.

(10) Patent No.: US 8,453,758 B2
(45) Date of Patent: Jun. 4, 2013

(54) DUAL DENSITY MUD RETURN SYSTEM

(75) Inventors: Edward E. Horton, III, Houston, TX (US); Lyle David Finn, Sugar Land, TX (US); James V. Maher, Houston, TX (US); Greg Navarre, Houston, TX (US)

(73) Assignee: Horton Wison Deepwater, Inc., Houston, TX (US)

( * ) Notice: Subject to any disclaimer, the term of this patent is extended or adjusted under 35 U.S.C. 154(b) by 0 days.

(21) Appl. No.: 13/555,407

(22) Filed: Jul. 23, 2012

(65) Prior Publication Data

US 2012/0285698 A1 Nov. 15, 2012

Related U.S. Application Data

(63) Continuation of application No. 12/131,598, filed on Jun. 2, 2008, now Pat. No. 8,322,460.

(60) Provisional application No. 60/941,523, filed on Jun. 1, 2007.

(51) Int. Cl.
*E21B 15/02* (2006.01)
*E21B 19/00* (2006.01)

(52) U.S. Cl.
USPC ..... 175/5; 175/207; 166/344; 166/352; 166/358; 166/400; 166/90.1

(58) Field of Classification Search
USPC ..... 175/5–10, 207, 209, 215–218; 166/344, 166/347, 352, 357, 358, 367, 268, 400, 90.1
See application file for complete search history.

(56) References Cited

U.S. PATENT DOCUMENTS

| | | | | | |
|---|---|---|---|---|---|
| 3,603,409 | A | * | 9/1971 | Watkins | 175/7 |
| 4,063,602 | A | * | 12/1977 | Howell et al. | 175/7 |
| 4,091,881 | A | * | 5/1978 | Maus | 175/7 |
| 4,149,603 | A | * | 4/1979 | Arnold | 175/7 |
| 4,291,772 | A | * | 9/1981 | Beynet | 175/5 |
| 4,633,951 | A | * | 1/1987 | Hill et al. | 166/308.1 |
| 4,683,943 | A | * | 8/1987 | Hill et al. | 166/63 |
| 4,718,493 | A | * | 1/1988 | Hill et al. | 166/308.1 |
| 4,823,875 | A | * | 4/1989 | Hill | 166/280.1 |
| 5,617,921 | A | * | 4/1997 | Schmidt et al. | 166/308.1 |
| 5,727,640 | A | * | 3/1998 | Gleditsch | 175/7 |

(Continued)

OTHER PUBLICATIONS

PCT/US2008/065524 International Search Report and Written Opinion dated Dec. 18, 2008 (14 p.).

(Continued)

*Primary Examiner* — Matthew Buck
(74) *Attorney, Agent, or Firm* — Conley Rose, P.C.

(57) ABSTRACT

Systems and methods for lifting drilling fluid from a well bore in a subsea formation are disclosed. Some system embodiments include a drill string suspended within a drilling riser to form the well bore, and a drilling fluid source for supplying drilling fluid through the drill string during drilling. A diverter is coupled between the drilling riser and a return line, while a power riser coupled to the return line at an interface. A lift fluid source supplies lift fluid through the power riser into the return line. The lift fluid is intermittently injected from the power riser through the interface into the return line to form one or more slugs of lift fluid positioned between slugs of drilling fluid, such that the combined density of lift fluid and drilling fluid in the return line is less than the density of the drilling fluid alone.

22 Claims, 6 Drawing Sheets

U.S. PATENT DOCUMENTS

| | | | | |
|---|---|---|---|---|
| 6,352,114 | B1 * | 3/2002 | Toalson et al. | 166/343 |
| 6,394,195 | B1 * | 5/2002 | Schubert et al. | 175/69 |
| 6,415,877 | B1 * | 7/2002 | Fincher et al. | 175/5 |
| 6,454,022 | B1 * | 9/2002 | Sangesland et al. | 175/7 |
| 6,457,529 | B2 * | 10/2002 | Calder et al. | 166/368 |
| 6,530,437 | B2 * | 3/2003 | Maurer et al. | 175/5 |
| 6,536,540 | B2 * | 3/2003 | de Boer | 175/70 |
| 6,578,637 | B1 * | 6/2003 | Maus et al. | 166/350 |
| 6,802,379 | B2 * | 10/2004 | Dawson et al. | 175/38 |
| 6,843,331 | B2 * | 1/2005 | de Boer | 175/70 |
| 6,854,532 | B2 * | 2/2005 | Fincher et al. | 175/5 |
| 6,926,101 | B2 * | 8/2005 | deBoer | 175/70 |
| 6,966,392 | B2 * | 11/2005 | deBoer | 175/70 |
| 7,090,036 | B2 * | 8/2006 | deBoer | 175/70 |
| 7,093,662 | B2 * | 8/2006 | deBoer | 166/358 |
| 7,350,597 | B2 * | 4/2008 | Reitsma et al. | 175/66 |
| 7,497,266 | B2 * | 3/2009 | Fossli | 166/358 |
| 7,721,807 | B2 * | 5/2010 | Stoisits et al. | 166/366 |
| 7,913,764 | B2 * | 3/2011 | Smith et al. | 166/358 |
| 8,066,076 | B2 * | 11/2011 | Donald et al. | 166/344 |
| 2002/0011338 | A1 | 1/2002 | Maurer et al. | |
| 2004/0084214 | A1 | 5/2004 | de Boer | |
| 2007/0107787 | A1 | 5/2007 | Moretz | |

OTHER PUBLICATIONS

Chinese Office Action dated May 25, 2012; Chinese Application No. 200880018465.2 (13 p.).

Office Action Dated Mar. 4, 2011; U.S. Appl. No. 12/131,598 (10 p.).

Response to Office Action Dated Mar. 4, 2011; U.S. Appl. No. 12/131,598; Response Filed Sep. 9, 2011 (14 p.).

Final Office Action Dated Feb. 16, 2012; U.S. Appl. No. 12/131,598 (6 p.).

Response to Final Office Action Dated Feb. 16, 2012; U.S. Appl. No. 12/131,598; Response Filed May 15, 2012 (8 p.).

Notice of Allowance Dated Jun. 1, 2012; U.S. Appl. No. 12/131,598 (7 p.).

* cited by examiner

DUAL DENSITY MUD RETURN SYSTEM

CROSS REFERENCE TO RELATED APPLICATIONS

This application is a continuation of U.S. application Ser. No. 12/131,598 filed Jun. 2, 2008, and entitled "Dual Density Mud Return System." which claims the benefit of U.S. provisional application Ser. No. 60/941,523 filed Jun. 1, 2007, and entitled "Apparatus and Method for Lifting Mud Returns to the Surface," which is hereby incorporated herein by reference in its entirety for all purposes.

STATEMENT REGARDING FEDERALLY SPONSORED RESEARCH OR DEVELOPMENT

Not applicable.

BACKGROUND OF THE INVENTION

Embodiments of the invention relate to mud return systems used in the oil production industry. More particularly, embodiments of the invention relate to a novel system and method for lifting mud returns to the sea surface by injecting a lift fluid into the mud.

When drilling an oil or gas well, a starter hole is first drilled and the drilling rig is then installed over the starter hole. Drill pipe is coupled to a drill bit and drill collar, which adds extra weight on the bit, to form the drill string. The drill string is coupled to the Felly joint and rotary table and then lowered into the starter hole. When the drill bit reaches the base of the starter hole, drilling may commence. As drilling progresses, drilling fluid, or mud, is circulated down through the drill pipe to lubricate and cool the drill bit as well as to provide a vehicle for removal of drill cuttings from the borehole. After emerging from the drill bit, the drilling fluid flows up the borehole through the annulus formed by the drill string and the borehole, i.e., the well bore annulus.

In addition to drill bit cooling, lubrication, and cuttings removal, the mud is used for well control. For instance, the mud is used to prevent formation fluid from entering the well bore. When the hydrostatic pressure of mud in the well bore annulus is equal to or greater than the formation pressure, formation fluid will not flow into the well bore and mix with the mud. The hydrostatic pressure of the mud is dependent upon the mud density and the vertical depth. Thus, to prevent formation fluid from flowing into the well bore, the mud is selected based on its density to provide a hydrostatic pressure exceeding the formation pressure. At the same time, however, the hydrostatic pressure of the mud must not exceed the fracture strength of the formation, thereby causing mud filtrate to invade the formation and a filter cake of mud to be deposited on the well bore wall.

As wells become deeper, balancing these two operational constraints becomes increasingly difficult. Moreover, in deep wells more than 30,000 feet below sea level and in water as deep as 10,000 feet, balancing these constraints is not possible because the weight of mud required to produce a hydrostatic pressure exceeding the formation pressure also produces a hydrostatic force exceeding the fracture strength of the formation. When such conditions exist, one solution that allows continued drilling is to case the well bore. Drilling then continues for a time before it is interrupted again and another casing string installed. Drilling then resumes, and so on. Setting multiple easing strings in this manner is, however, very expensive and eventually reduces the diameter of the well bore to the extent that further drilling is not warranted.

Thus, embodiments of the invention are directed to mud return systems that seek to overcome these and other limitations of the prior art.

SUMMARY OF THE PREFERRED EMBODIMENTS

Systems and methods for lifting drilling fluid from a well bore in a subsea formation are disclosed. Some system embodiments include a drilling riser, a drill string suspended within the drilling riser and adapted to form at least a portion of the well bore, and a drilling fluid source for supplying drilling fluid through the drill string. The drilling fluid exits from the drill string during drilling and returns up an annulus between the drilling riser and the drill string. The system embodiments further include a return line having a first end, a diverter coupled between the drilling riser and the first end of the return line, a power riser coupled to the return line at an interface positioned along the return line, and a lift fluid source for supplying lift fluid through the power riser into the return line. The diverter configured to selectably divert drilling fluid from the annulus into the return line. The lift fluid is intermittently injected from the power riser through the interface into the return line to form one or more slugs of lift fluid positioned between slugs of drilling fluid, such that a combined density of lift fluid and drilling fluid in the return line is less than the density of the drilling fluid alone. The interface is configured to prevent the drilling fluid from flowing into the power riser from the return line.

Some method embodiments for lifting drilling fluid from a well bore in a subsea formation include injecting a drilling fluid through a drill string, diverting the drilling fluid from the well bore into a return line, and injecting a lift fluid through a conduit and into the return line, such that a combined density of the lift fluid and the drilling fluid in the return line is less than the density of the drilling fluid alone.

Other system embodiments for lifting drilling fluid from a well bore in a subsea formation include a return line having a first end, a diverter spool positioned at the first end of the return line, a power riser coupled to the return line at an interface positioned along the return line, and a lift fluid source for supplying lift fluid through the power riser into the return line. The diverter spool is configured to selectably divert well bore fluid from the well bore into the return line. The lift fluid is injected from the power riser through the interface into the return line, such that a combined density of lift fluid and well bore fluid in the return line is less than the density of the well bore fluid alone. The interface is configured to prevent the well bore fluid inside the return line from flowing into the power riser.

Other methods for killing a well bore in a formation include suspending a drill string into the well bore, coupling a return line to the drill string using a diverter spool configured to divert fluid from the return line into the well bore, and injecting a heavy fluid through the return line and the diverter spool into the well bore, wherein the hydrostatic pressure of the heavy fluid injected into the well bore exceeds the pressure of fluid in the formation.

Still other system embodiments for lifting drilling fluid from a well bore in a formation include a tubular member extending between a packer and the well bore, a drill string suspended within the tubular member and adapted to form at least a portion of the well bore, and a drilling fluid source for supplying drilling fluid through the drill string. The drilling fluid exits from the drill string during drilling and returns up an annulus between the tubular member and the drill string. These system embodiments further include a supply line having a first end and a second end, a diverter coupled between the drilling riser and the first end of the supply line, an enclosure coupled to the second end of the supply line, a power riser having a first end disposed within the enclosure, a return line having a first end disposed within the enclosure, an interface coupled between the power riser and the return line, and a lift fluid source for supplying lift fluid through the power riser. The diverter configured to selectably divert drilling fluid from the annulus into the supply line. The enclosure is configured to receive and contain drilling fluid from the supply line. The lift fluid is intermittently injected from the power riser through the interface into the return line to form one or more slugs of lift fluid positioned between slugs of drilling fluid, such that a combined density of lift fluid and drilling fluid in the return line is less than the density of the drilling fluid alone. The interface is configured to prevent the drilling fluid from flowing into the power riser from the return line.

Still other method embodiments for lifting drilling fluid from a well bore in a formation include injecting a drilling fluid through a drill string, diverting the drilling fluid from the well bore into an enclosure, injecting a lift fluid through a conduit and into the enclosure. and forcing the drilling fluid from the enclosure through a return line, wherein the density of the lift fluid is less than the density of the drilling fluid.

Some embodiments of a diverter shuttle valve include an outer housing having a cavity therein and an inner housing having a flowbore therethrough, wherein the inner housing is free to translate within the cavity of the outer housing. The outer housing further includes a first end and a plurality of openings. The inner housing further includes a first end and a plurality of openings. A flowpath is established between the openings of the inner housing and the openings of the outer housing when the openings of the inner housing are aligned with the openings of the outer housing.

Thus, the embodiments of the invention comprise a combination of features and advantages that enable substantial enhancement of mud return systems. These and various other characteristics and advantages of the invention will be readily apparent to those skilled in the art upon reading the following detailed description of the preferred embodiments of the invention and by referring to the accompanying drawings.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
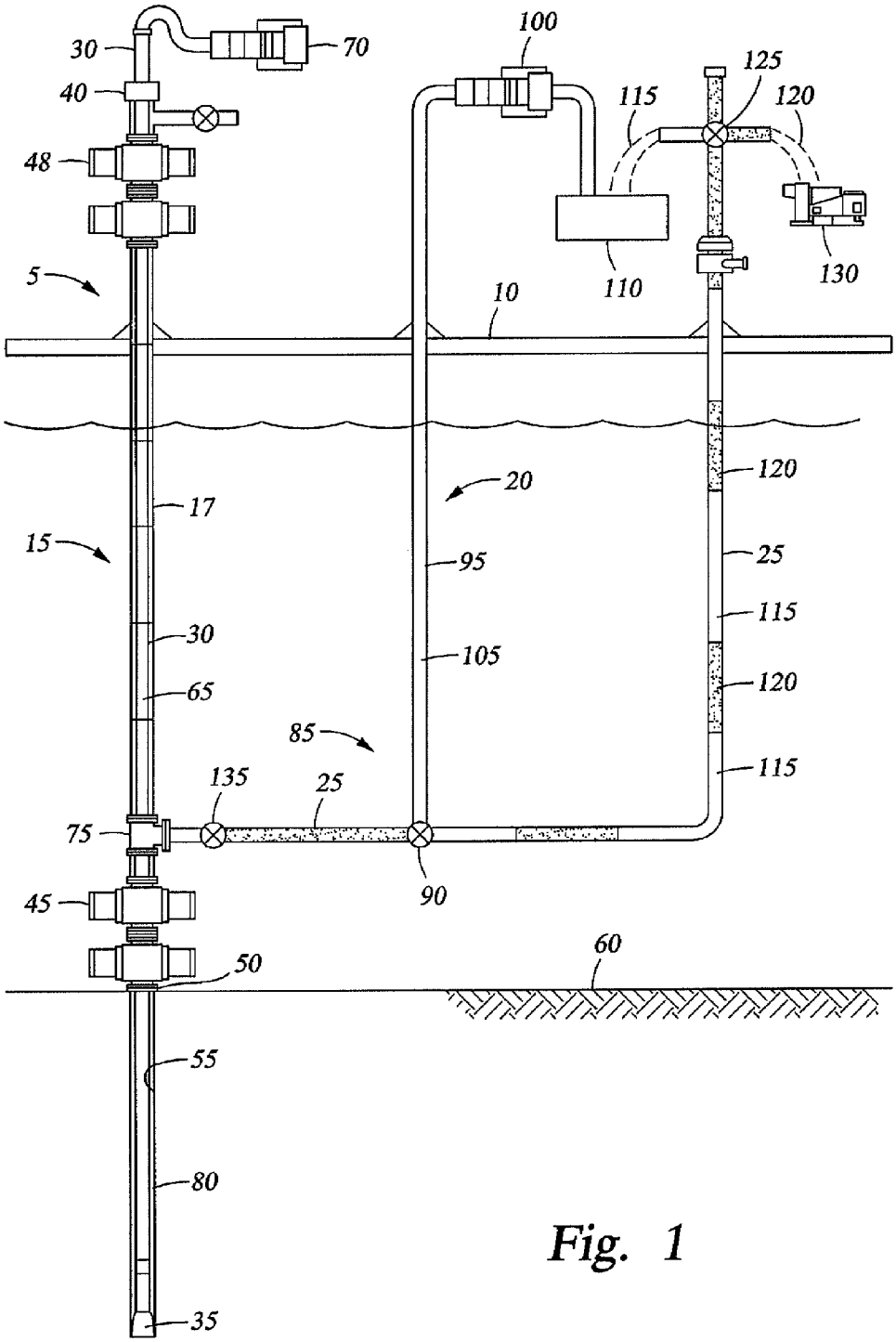
FIG. 1 is a schematic representation of a drilling structure with a dual density mud return system in accordance with embodiments of the invention.

Various embodiments of the invention will now be described with reference to the accompanying drawings, wherein like reference numerals are used for like parts throughout the several views. The drawing figures are not necessarily to scale. Certain features of the invention may be shown exaggerated in scale or in somewhat schematic form, and some details of conventional elements may not be shown in the interest of clarity and conciseness.

Preferred embodiments of the invention relate to dual density mud return systems used in the recycling of drilling fluid. The invention is susceptible to embodiments of different forms. There are shown in the drawings, and herein will be described in detail, specific embodiments of the invention with the understanding that the disclosure is to be considered an exemplification of the principles of the invention and is not intended to limit the invention to that illustrated and described herein. It is to be fully recognized that the different teachings of the embodiments discussed below may be employed separately or in any suitable combination to produce desired results.

FIG. 1 depicts a representative drilling structure 5, which may be any structure, whether land-based or over water, from which drilling of a well is performed, including, but not limited to, a floating vessel, a fixed or floating platform, or a drilling rig. Drilling structure 5 includes a deck or platform 10. A riser 17 is suspended through platform 10, a packer 40, two blowout preventers 45, 48, and a well head 50 into a well bore 55. A drill string 15 is inserted into riser 17 for the purpose of drilling well bore 55 to a desired depth. Packer 40 and accompanying pressure control means (not shown) are operable to control the pressure of drilling fluid in the drill string 15. In some embodiments, packer 40 is a rotating packer, for example, a Weatherford rotating packer, and pressure control means includes an accumulator and/or a valve. Blowout preventers 45, 48 form a split BOP stack operable to relieve pressure in the well bore 55. The upper BOP 48 is positioned at the surface above platform 10 and controls well kicks and other normal well functions. The lower BOP 45 is positioned at the seafloor 60 and serves as an emergency and last resort function to shut off the well. Wellhead 50 is positioned over the well bore 55 at the sea floor 60 to support drill string 15.

Drill string 15 includes one or more drill pipe joints 30 coupled to a drill bit 35. For purposes including cooling and lubrication of drill bit 35 and cuttings removal during drilling operations, drilling fluid 65 is pumped downward through drill string 15 to drill bit 35 using one or more mud pumps 70 positioned on platform 10 of drilling structure 5. In some embodiments, drilling fluid 65 is mud. The density of drilling fluid 65 is carefully controlled to provide sufficient weight to produce a hydrostatic force exceeding the formation pressure, thereby preventing formation fluid from exiting the formation and mixing with drilling fluid 65 in well bore 55.

As previously described, it is also desirable to maintain the hydrostatic force of drilling fluid 65 below the fracture strength of the formation so as to prevent drilling fluid 65 from flowing into the formation and a filter cake of drilling fluid 65 being deposited on the wall of well bore 55. While the hydrostatic force of drilling fluid 65 can be controlled between the formation pressure and the formation fracture strength, drilling fluid 65 may be returned through an annulus 80, located between the outer surface of drill pipe joints 30 and the inner surface of riser 17, to the surface for recycling and reuse.

Controlling the hydrostatic force of drilling fluid 65 in this manner becomes more difficult, or in some cases, even impossible, as well bore 55 deepens. Embodiments of the invention provide a solution to this problem, namely a dual density mud return system. A dual density mud return system provides an alternative path for returning drilling fluid 65 to drilling structure 5, allowing the hydrostatic pressure of drilling fluid 65 in well bore 55 to be maintained above the formation pressure but below the formation fracture strength, even in deep wells. Thus, the dual density mud return system allows drilling fluid 65 to be recycled and reused, while at the same time preventing damage to the formation.

A representative embodiment of a dual density mud return system is also depicted in FIG. 1. Dual density mud return system 85 includes diverter spool 75, power riser 20, and mud return conduit 25. In the embodiment shown, diverter spool 75 is positioned along riser 17, just above blowout preventer 45 and wellhead 50. Although shown near wellhead 50, diverter spool 75 may be positioned anywhere along riser 17. Mud return conduit 25 is coupled at one end to riser 17 by diverter spool 75 and at the other end to drilling structure 5. Mud return conduit 25 includes shut-off valve 135 positioned between diverter spool 75 and interface 90. Diverter spool 75 is selectively actuatable to allow or prevent drilling fluid 65 to be diverted from annulus 80 into mud return conduit 25. Shut-off valve 135 is selectively actuatable between open and closed positions to allow or prevent, respectively, drilling fluid 65 to pass therethrough.

Power riser 20 includes lift fluid conduit 95 and lift fluid pump 100. Lift fluid 105, stored in lift fluid pit 110 positioned on platform 10, is conveyed by lift fluid pump 100 through lift fluid conduit 95 and interface 90 into mud return conduit 25. Lift fluid 105 has density that is lower than that of drilling fluid 65. In some embodiments, lift fluid 105 is fresh water, seawater or other drilling fluid. Further, lift fluid 105 can be a liquid or a gas.

Power riser 20 is coupled by interface 90 to mud return conduit 25. Interface 90 selectively allows the flow of lift fluid 105 from power riser 20 into mud return conduit 25 while at the same time preventing the flow of drilling fluid 65 from mud return conduit 25 into power riser 20. In some embodiments, interface 90 is a check valve, intermittent diverter, or diverter shuttle valve, described in detail below.

During drilling operations, when well bore 55 reaches depths at which maintaining the hydrostatic pressure of drilling fluid 65 above the formation pressure yet below the formation fracture strength is difficult, or impossible, a decision may be made to return drilling fluid 65 via dual density mud return system 85, instead of the conventional path along annulus 80 through riser 17. Diverter spool 75 is actuated to divert drilling fluid 65 from annulus 80 into mud return conduit 25, and shut-off valve is opened to allow drilling fluid 65 to flow therethrough. Thus, drilling fluid 65 is diverted along mud return conduit 25 to the surface, and drilling operations continue uninterrupted by the flow diversion.

To assist in return of drilling fluid 65 to the surface, lift fluid 105 is injected through interface 90 into mud return conduit 25 to produce one or more slugs 115 of lift fluid 105 positioned between slugs 120 of drilling fluid 65, such that the combined density, or "dual density," of lift fluid 105 and drilling fluid 65 in mud return conduit 25 is less than the density of drilling fluid 65. In other words, a lighter lift fluid 105 is injected into drilling fluid 65 to produce fluid in mud return conduit 25 that is lighter than would be the case if drilling fluid 65 were the only fluid in conduit 25, and therefore easier to convey or "lift" to the surface. The volume of each lift fluid slug 115 and the frequency at which each slug 115 is injected into mud return conduit 25 is carefully controlled to achieve a desired combined fluid density. The slug 115 volume and frequency may be varied to accommodate a wide range of operating conditions, including the density and/or viscosity of drilling fluid 65, the density and/or viscosity of lift fluid 105, the relative difference between the two, mud pump 70 flow rates and formation characteristics. For example, the quantity of lift fluid 105 injected may be controlled to produce slugs 115 of lift fluid 105 each having a volume three times larger than that of each slug 120 of drilling fluid 65.

Moreover, intermittently injecting lift fluid 105 into drilling fluid 65 to produce slugs 115 of lift fluid 105 positioned between slugs 120 of drilling fluid 65 allows for easier separation of lift fluid 105 and drilling fluid 65 at the surface. For instance, mud return conduit 25 further comprises valve 125 positioned at the surface. As slugs 120 of drilling fluid 65 return through mud return conduit 25, slugs 120 are diverted by operation of valve 125 to mud shaker 130 for recycling and reuse. Furthermore, mud shaker 130 may be coupled to mud pump 70 so that recycled drilling fluid 65 can be re-injected into well bore 55 via drill string 30. Similarly, as slugs 115 of lift fluid 105 return through mud return conduit 25, slugs 115 are diverted by further operation of valve 125 to lift fluid pit 110, where they too can be recycled and reused.

Figure 2A:
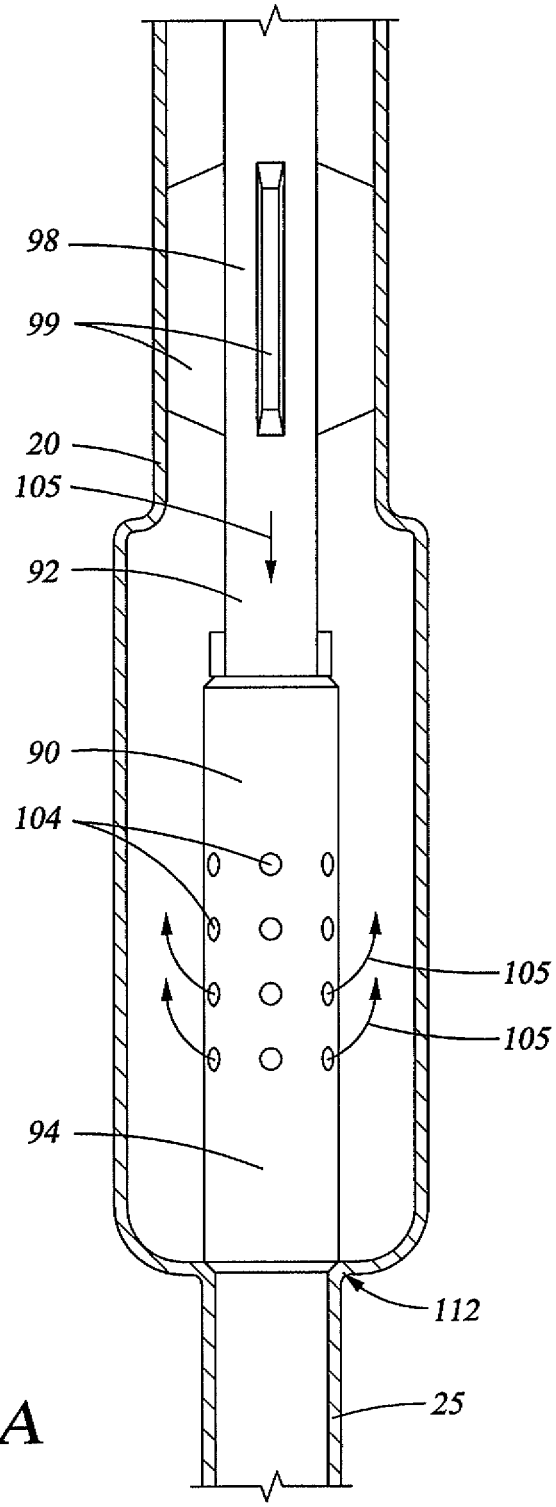
FIGS. 2A and 2B are schematic representations of a diverter shuttle valve in accordance with embodiments of the invention.
Figure 2B:
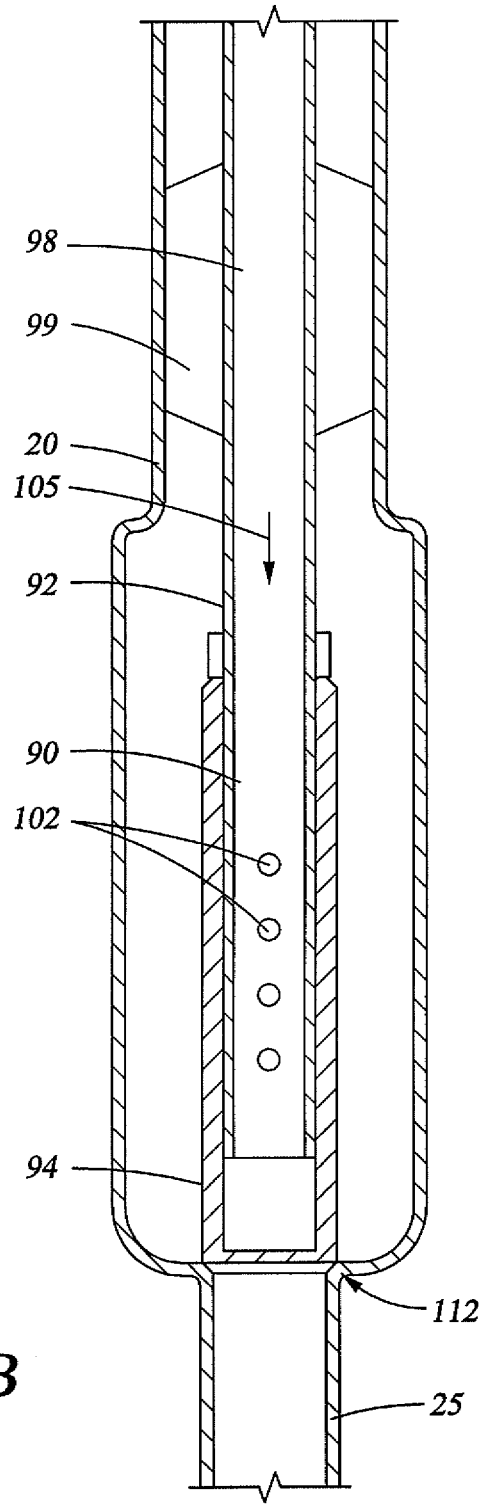

In preferred embodiments of dual density mud return system 85, interface 90 is a diverter shuttle valve. FIGS. 2A and 2B are cross-sectional views of an exemplary diverter shuttle valve 90 comprising two cylindrical, concentric hollow housings 92, 94. Inner housing 92 is configured to translate at least partially within outer housing 94. Inner housing 92 has two ends 96, 98. End 96 is disposed within outer housing 94, while end 98 is not. Inner housing 92 further includes a plurality of fins 99 positioned circumferentially about end 98 and a plurality of openings 102, which are circumferentially spaced about end 96. Fins 99 preferably extend to the inner wall of mud openings return conduit 25 to centralize diverter shuttle valve 90 within mud return conduit 25. Outer housing 94 also comprises a plurality of openings 104, such that when end 96 of inner housing 92 abuts end 106 of outer housing 94, openings 102 of inner housing 92 and openings 104 of outer housing 94 align to form a flow path therethrough. Although complete alignment of openings 102 and 104 is preferred, it is not required and offset alignment may provide all functional needs. Further, although openings 102 and 104 are shown as circular, they may take any shape or size.

During operation of a dual density mud return system 85 comprising diverter shuttle valve 90, lift fluid 105 is injected through power riser 20. The injected lift fluid 105 acts on diverter shuttle valve 90, causing inner housing 92 to translate within outer housing 94 until, in the preferred embodiment, end 96 of inner housing 92 abuts end 106 of outer housing 94 and perforations 102 of inner housing 92 align with perforations 104 of outer housing 94. After this contact, the assembly 92, 94 translates further until end 106 of outer housing 94 abuts neck 140 of mud return conduit 25, thereby forming a seal 112 which interrupts the flow of drilling fluid 65 through mud return conduit 25 at this location. Lift fluid 105 is then forced through aligned perforations 102, 104 to form a slug 115 of lift fluid 105 within mud return conduit 25. FIG. 2A depicts perforations 102, 104 aligned, lift fluid 105 injected through aligned perforations 102, 104, and the flow of drilling fluid 65 through neck 140 of mud return conduit 25 interrupted.

After a quantity of lift fluid 105 has been injected in this manner, injection of lift fluid 105 into power riser 20 is interrupted. Thus, the pressure load exerted by lift fluid 105 on diverter shuttle valve 90 is removed. Due to the pressure load of drilling fluid 65 acting on end 106 of outer housing 94, outer housing 94, with inner housing 92 contained therein, translates and drilling fluid 65 flow through neck 140 of mud return conduit 25 is re-established to form a slug 120 of drilling fluid 65 within mud return conduit 25. Slug 120 circulates around diverter shuttle valve 90 and contacts fins 96 of inner housing 92. This contact causes inner housing 92 to translate within outer housing 94, which in turn, causes misalignment of perforations 102, 104 and interrupts the flow of lift fluid 105 therethrough. FIG. 2B depicts perforations 102, 104 misaligned, the flow of lift fluid 105 through perforations 102, 104 interrupted, and the flow of drilling fluid 65 through neck 140 of mud return conduit 25 re-established.

Thus, by injecting lift fluid 105 through power riser 20, diverter shuttle valve 90 translates in one direction to form a slug 115 of lift fluid 105 within mud return conduit 25. By discontinuing the injection of lift fluid 105, diverter shuttle valve 90 then translates in the opposite direction to form a slug 120 of drilling fluid 65. Moreover, by controlling the intermittent injection of lift fluid 105 in this manner, slugs 115 of lift fluid 105 may be interspersed between slugs 120 of drilling fluid 65 within mud return conduit 25.

Diverter spool 75, shut-off valve 135, mud return conduit 25 and power riser 20 are all designed to withstand abnormally high pressure loads, unlike riser 17, which is typically thin-walled. Therefore, in the event that pressure in well bore 55 unexpectedly reaches abnormally high levels, drilling fluid 65 may be diverted from annulus 80 within riser 17 into dual density mud return system 85. As described above, diverter spool 75 is actuated to divert high pressure drilling fluid 65 from annulus 80 into mud return conduit 25. Shut-off valve 135 is opened to allow high pressure drilling fluid 65 to flow along conduit 25 to the surface. While the high pressure drilling fluid 65 is diverted through dual density mud return system 85 to the surface, drilling operations may proceed uninterrupted and damage to drill string 15 is prevented.

In the event that pressure in well bore 55 reaches abnormally high levels and a decision is made to "kill" the well, drilling operations cease. Diverter spool 75 is actuated to allow drilling fluid 65 to flow from mud return conduit 25 into well bore 55, and shut-off valve 135 is opened to allow drilling fluid 65 flow therethrough. Heavy drilling fluid 65 is then pumped from the surface downward through mud return conduit 25, shut-off valve 135, and diverter spool 75 into well bore 55. Upon injection into well bore 55, heavy drilling fluid 65 enters the formation to stop flow of formation fluid into well bore 55, thereby "killing" the well.

To assist in killing the well, lift fluid 105 may be injected through interface 90 into mud return conduit 25 to produce one or more slugs 115 of lift fluid 105 positioned between slugs 120 of drilling fluid 65, such that the combined density, or "dual density," of lift fluid 105 and drilling fluid 65 in mud return conduit 25 is greater than the density of drilling fluid 65. In other words, a heavier lift fluid 105 is injected into drilling fluid 65 to produce fluid in mud return conduit 25 that is heavier than would be the case if drilling fluid 65 were the only fluid in conduit 25, and therefore heavier to kill the well. The volume of each lift fluid slug 115 and the frequency at which each slug 115 is injected into mud return conduit 25 is carefully controlled to achieve a desired combined fluid density. As before, the slug 115 volume and frequency may be varied to accommodate a wide range of operating conditions, including the density and/or viscosity of drilling fluid 65, the density and/or viscosity of lift fluid 105, the relative difference between the two, mud pump 70 flow rates and formation characteristics.

Figure 3:
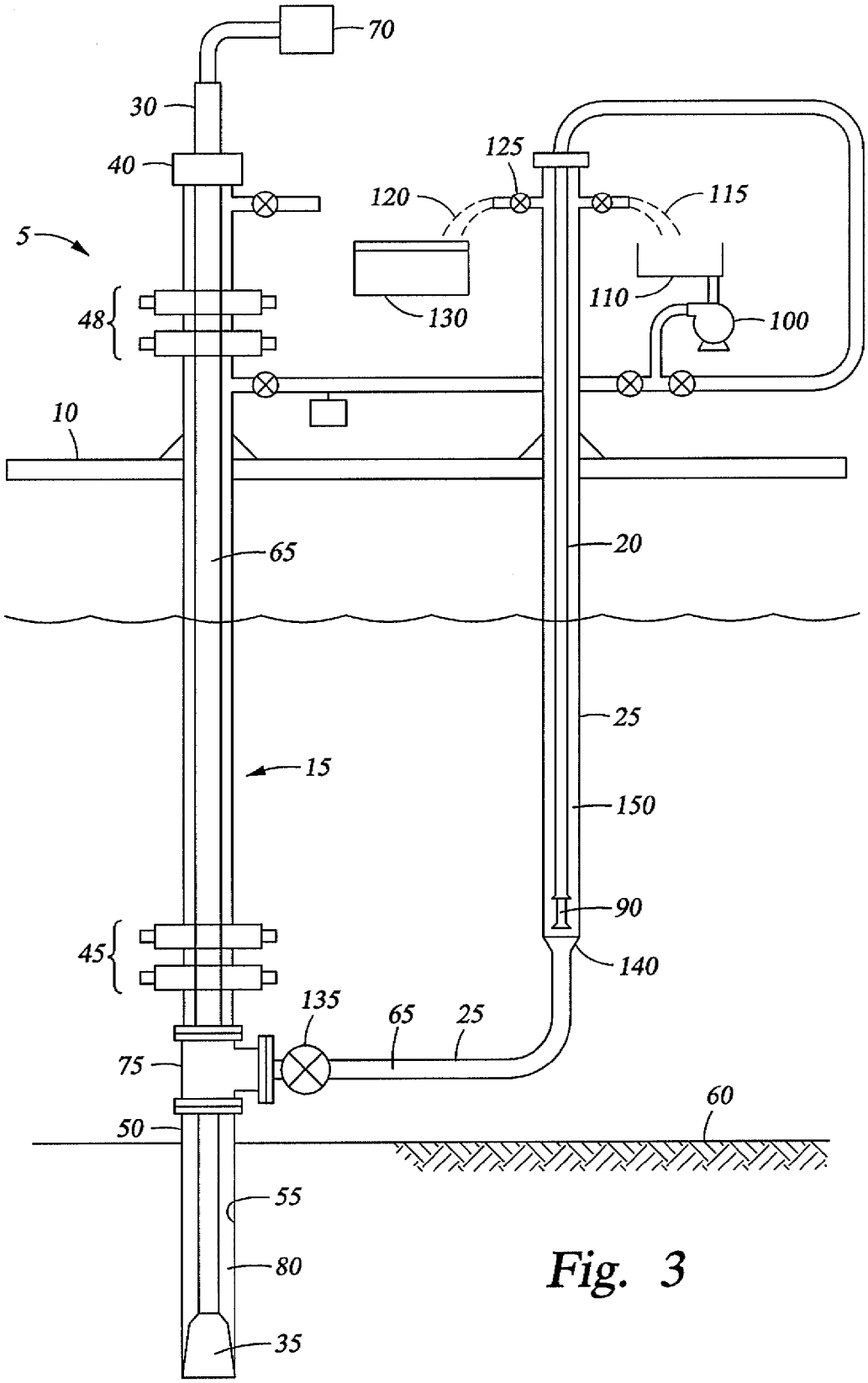
FIG. 3 is a schematic representation of the drilling structure with another exemplary embodiment of a dual density mud return system with the power riser positioned concentrically within the mud return conduit.

The exemplary dual density mud return system 85 depicted in FIG. 1 shows mud return conduit 25 and power riser 20 spaced apart some distance. In some embodiments, however, one may be concentric about the other. For example, power riser 20 may be concentrically positioned within mud return conduit 25, as illustrated in FIG. 3. In such embodiments, slugs 120 of drilling fluid 65 interspersed with slugs 115 of lift fluid 105 return to the surface through annulus 150 between the outer surface of power riser 20 and the inner surface of mud return conduit 25. Aside from these differences, system 85 and its operation remain substantially the same as that described above in reference to FIG. 1.

Figure 4:
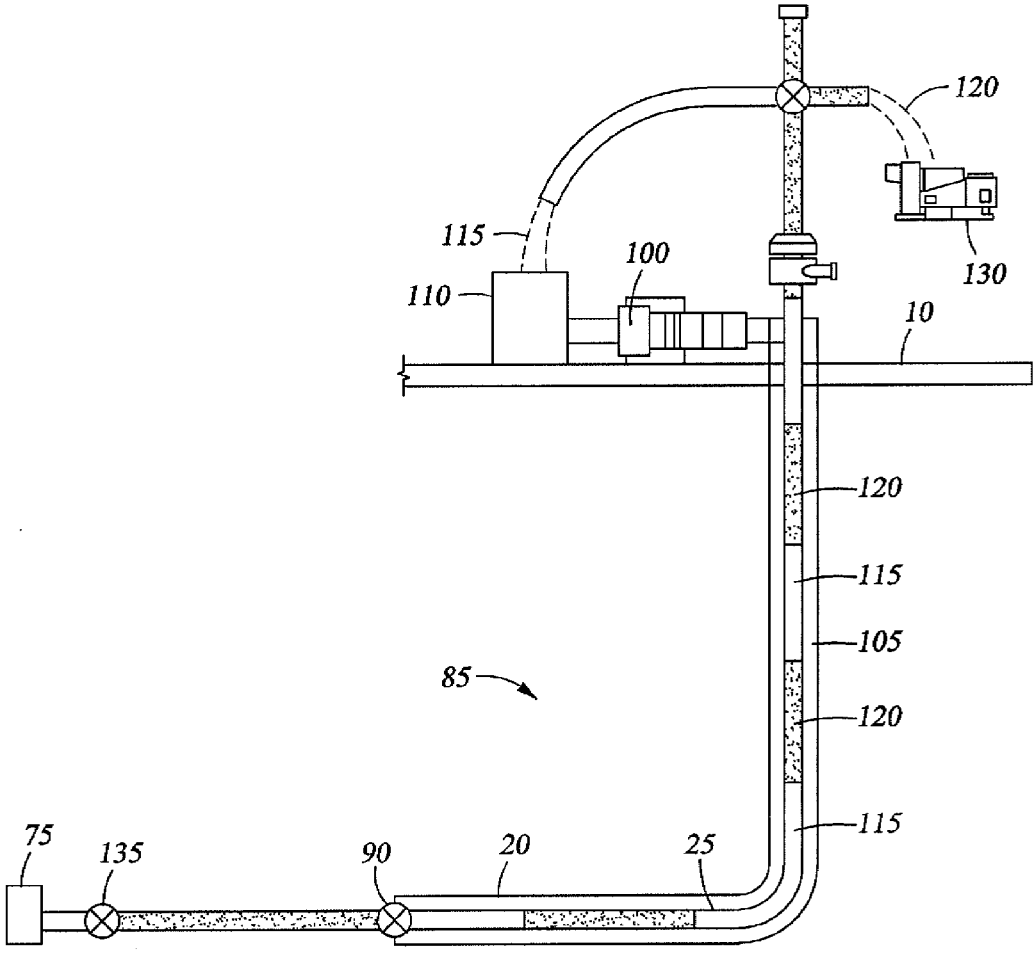
FIG. 4 is an exemplary embodiment of a dual density mud return system with the mud return conduit positioned concentrically within the power riser.

Alternatively, mud return conduit 25 may be positioned concentrically within power riser 20, as illustrated in FIG. 4. In such system configurations, slugs 120 of drilling fluid 65 interspersed with slugs 115 of lift fluid 105 return to the surface through mud return conduit 25. Aside from these differences, system 85 and its operation remain substantially the same as that described above in reference to FIG. 1.

In embodiments where power riser 20 is concentric about mud return conduit 25, or vice versa, interface 90 may simply be a seal formed between the two conduits 20, 25. For example, similar to FIG. 3, power riser 20 may be concentrically positioned with mud return conduit 25. Power riser 20 may be translated in a first direction, e.g., downward, to form a seal with neck 140 of mud return conduit 25, thereby preventing the flow of lift fluid 105 from power riser 20 into mud return conduit 25. Power riser 20 may then be subsequently translated in the opposite direction, e.g., upward, to break that seal and re-establish the flow of lift fluid 105 into mud return conduit 25. Thus, translating power riser 20 in a first direction to form a seal between power riser 20 and mud return conduit 25 and subsequently in the opposite direction to break that seal produces slugs 115 of lift fluid 105 interspersed between slugs 110 of drilling fluid 65.

In the exemplary embodiments illustrated by FIGS. 1 through 4, drilling structure 5 included riser 17 through which drilling fluid 65 may be returned to the surface. Other drilling structures, however, may not include a riser for this purpose. Such riserless drilling structures may instead utilize a dual density mud return system to return drilling fluid to the surface at all times.

Figure 5:
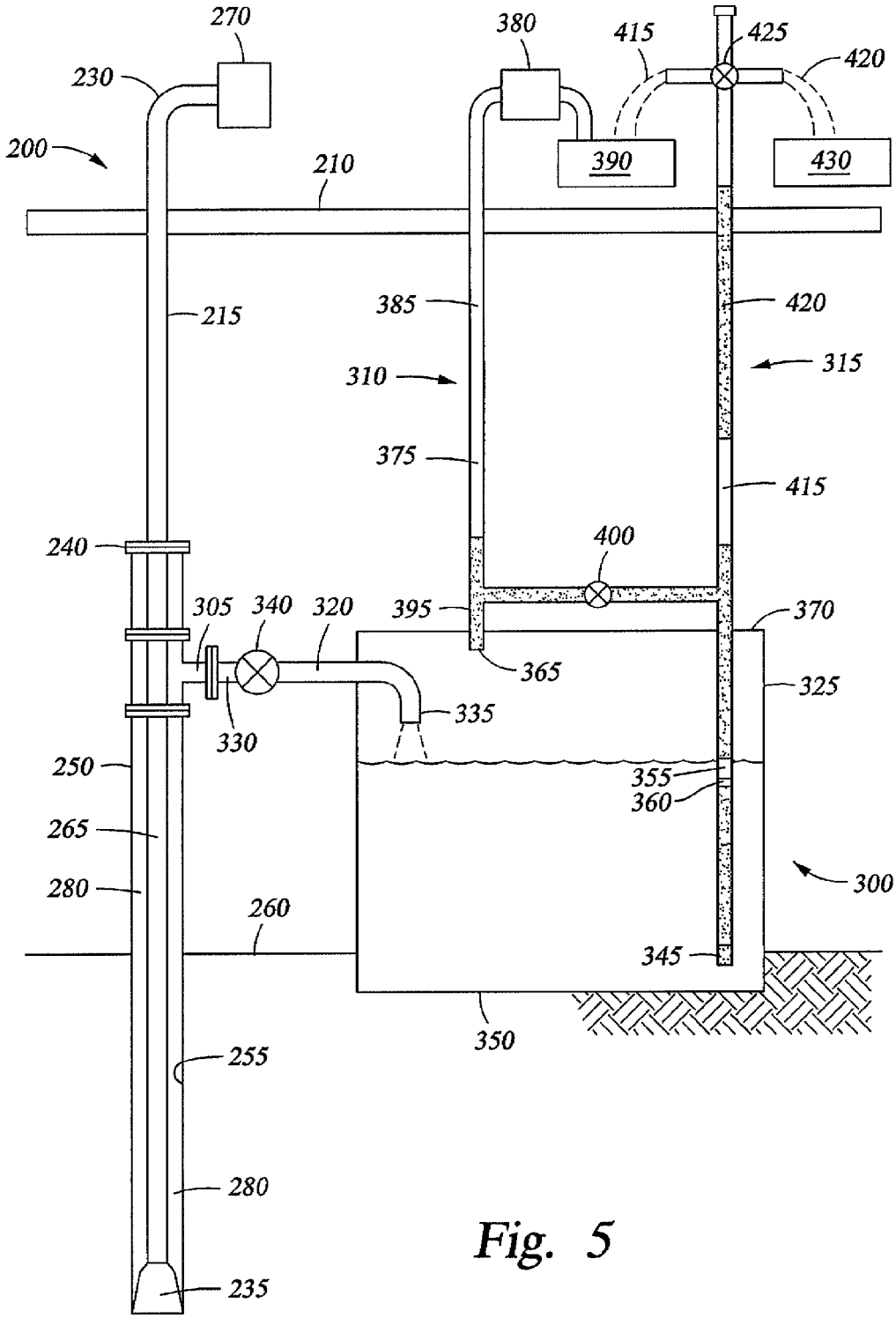
FIG. 5 is a schematic representation of a riserless drilling structure with another embodiment of a dual density return system.

Turning now to FIG. 5, a representative riserless drilling structure 200 is depicted. Riserless drilling structure 200 may be any structure, whether land-based or over water, from which drilling of a well is performed, including, but not limited to, a floating vessel, a fixed or floating platform, or a drilling rig. Drilling structure 200 includes a deck or platform 210. A drill string 215 is suspended through platform 210 and a packer 240 into a well bore 255 for the purpose of drilling well bore 255 to a desired depth. Packer 240 and accompanying pressure control means (not shown) are operable to control the pressure of drilling fluid in the drill string 215. In some embodiments, packer 240 is a rotating packer, for example, a Weatherford rotating packer, and pressure control means includes an accumulator and/or a valve. A conductor 250 is positioned over well bore 255 at the sea floor 260 to support drill string 215, and extends between packer 240 and well bore 255.

Drill string 215 includes one or more drill pipe joints 230 coupled to a jetting head 235. For the purpose of cuttings removal during drilling operations, drilling fluid 265, such as mud, is pumped downward through drill string 215 to jetting head 235 using one or more mud pumps 270 positioned on platform 210 of drilling structure 200. Upon exiting jetting head 235, drilling fluid 265 passes upward through an annulus 280 located between the outer surface of drill pipe joints 230 and the inner surface of conductor 250 and into a dual density mud return system 300. Dual density mud return system 300 returns drilling fluid 265 to the surface for recycling and reuse.

Dual density mud return system 300 includes diverter spool 305, power riser 310, mud return conduit 315, a supply conduit 320 and a sister 325. In this exemplary embodiment, diverter spool 305 is positioned along conductor 250, just below packer 240. Although shown near packer 240, diverter spool 305 may be positioned anywhere along conductor 250. Supply conduit 320 is coupled at one end 330 to conductor 250 by diverter spool 305. Diverter spool 305 is selectively actuatable to allow or prevent drilling fluid 265 to be diverted from annulus 280 into supply conduit 320. The other end 335 of supply conduit 320 is enclosed within sistern 325. Supply conduit 320 includes shut-off valve 340 positioned between diverter spool 305 and end 335. Shut-off valve 340 is selectively actuatable between open and closed positions to allow or prevent, respectively, drilling fluid 265 to pass therethrough.

Sistern 325 is an enclosure or reservoir positioned at the mud line 327 for receiving and containing drilling fluid 265. Drilling fluid 265 that is diverted from annulus 280 is delivered through diverter spool 305 and supply conduit 320 into sistern 325. Mud return conduit 315 extends between sistern 325 and drilling structure 200, such that its lower end 345 is disposed within sistern 325 proximate the base 350 of sistern 325 and below the surface of any drilling fluid 265 contained therein. Mud return conduit 315 includes a check valve 355. Check valve 355 is selectively actuatable between open and closed positions to allow or prevent, respectively, drilling fluid 265 to pass therethrough. In some embodiments, a screen 360 is coupled to check valve 355 to prevent large particles contained within drilling fluid 265 from passing through check valve 355.

Power riser 310 extends between sistern 325 and drilling structure 200, such that its lower end 365 is disposed within sistern 325 proximate the top 370 of sister 325 and above the surface of any drilling fluid 265 contained therein. Power riser 310 includes lift fluid conduit 375 with a lift fluid pump 380 coupled thereto. Lift fluid 385, stored in a lift fluid pit 390 positioned on platform 210, is conveyed by lift fluid pump 380 through lift fluid conduit 375 into sistern 325. Lift fluid 385 has density that is lower than that of drilling fluid 265. In some embodiments, lift fluid 385 is fresh water, seawater or other drilling fluid. Further, lift fluid 385 can be a liquid or a gas. Power riser 310 further includes a check valve 395 proximate lower end 365. Check valve 395 is selectively actuatable between open and closed positions to allow or prevent, respectively, lift fluid 265 to pass therethrough.

Power riser 20 is coupled by interface 400 to mud return conduit 315. Interface 400 selectively allows the flow of lift fluid 385 from power riser 310 into mud return conduit 315 while at the same time prevents the flow of drilling fluid 265 from mud return conduit 315 into power riser 310. In some embodiments, interface 400 is a bypass conduit coupled to a check valve, intermittent diverter, or diverter shuttle valve, described in detail above.

During drilling operations, drilling fluid 265 is delivered by mud pump 270 through drill string 215 and jetting head 235 into well bore 255. Diverter spool 305 is actuated to divert drilling fluid 265 from annulus 280 into supply conduit 320, and shut-off valve 340 is opened to allow drilling fluid 265 to flow therethrough. Drilling fluid 265 passes through supply conduit 320 and into sistern 325.

To return drilling fluid 265 contained within sistern 325 to the surface, check valve 395 of power riser 310 is opened, and lift fluid 385 is injected through lift fluid conduit 375 and check valve 395 into sistern 325. As the pressure of lift fluid 385 builds above drilling fluid 265 within sistern 325, drilling fluid 265 is forced upward through end 345 of mud return conduit 315. Check valve 355 is opened to allow drilling fluid 265 to pass therethrough and return to the surface.

To assist the return of drilling fluid 265 to the surface, lift fluid 385 is injected through interface 400 into mud return conduit 315 to produce one or more slugs 415 of lift fluid 385 positioned between slugs 420 of drilling fluid 265, such that the combined density, or "dual density," of lift fluid 385 and drilling fluid 265 in mud return conduit 315 is less than the density of drilling fluid 265. In other words, a lighter lift fluid 385 is injected into drilling fluid 265 to produce fluid in mud return conduit 315 that is lighter than would be the case if drilling fluid 265 were the only fluid in conduit 315, and therefore easier to convey or "lift" to the surface.

Prior to injecting lift fluid 385 in this manner to produce a slug 415 of lift fluid 385 in mud return conduit 315, shut-off valve 340 of supply conduit 320, check valve 310 of power riser 310 and check valve 355 of mud return conduit 315 are closed. Once these valves 340, 310, 355 are closed, lift fluid 385 is injected through interface 400 as described. When the desired quantify of lift fluid 385 has been injected, shut-off valve 340, check valve 310 and check valve 355 are again opened to allow drilling fluid 265 to return through mud return conduit 315 to the surface.

The volume of each lift fluid slug 415 and the frequency at which each slug 415 is injected into mud return conduit 325 is carefully controlled to achieve a desired combined fluid density. The slug 415 volume and frequency may be varied to accommodate a wide range of operating conditions, including the density and/or viscosity of drilling fluid 265, the density and/or viscosity of lift fluid 385, the relative difference between the two, mud pump 270 flow rates and formation characteristics. For example, the quantity of lift fluid 385 injected may be controlled to produce slugs 415 of lift fluid 385 each having a volume three times larger than that of each slug 420 of drilling fluid 265.

Moreover, intermittently injecting lift fluid 385 into drilling fluid 265 to produce slugs 415 of lift fluid 385 positioned between slugs 420 of drilling fluid 265 allows for easier separation of lift fluid 385 and drilling fluid 265 at the surface. For instance, mud return conduit 315 further comprises valve 425 positioned at the surface. As slugs 420 of drilling fluid 265 return through mud return conduit 315, slugs 420 are diverted by operation of valve 425 to mud shaker 430 for recycling and reuse. Furthermore, mud shaker 430 may be coupled to mud pump 270 so that recycled drilling fluid 265 can be re-injected into well bore 255 via drill string 215. Similarly, as slugs 415 of lift fluid 385 return through mud return conduit 315, slugs 415 are diverted by further operation of valve 425 to lift fluid pit 390, where they too can be recycled and reused.

The exemplary dual density mud return system 300 depicted in FIG. 5 shows mud return conduit 315 and power riser 310 spaced apart some distance. In some embodiments, however, one may be concentric about the other. For example, power riser 310 may be concentrically positioned within mud return conduit 315, similar to that illustrated in FIG. 3. In such embodiments, slugs 420 of drilling fluid 265 interspersed with slugs 415 of lift fluid 385 return to the surface through an annulus between the outer surface of power riser 310 and the inner surface of mud return conduit 315. Aside from these differences, system 300 and its operation remain substantially the same as that described above in reference to FIG. 5.

Alternatively, mud return conduit 315 may be positioned concentrically within power riser 310, as illustrated in FIG. 4. In such system configurations, slugs 420 of drilling fluid 265 interspersed with slugs 415 of lift fluid 385 return to the surface through mud return conduit 315. Aside from these differences, system 300 and its operation remain substantially the same as that described above in reference to FIG. 5.

While preferred embodiments have been shown and described, modifications thereof can be made by one skilled in the art without departing from the scope or teachings herein. The embodiments described herein are exemplary only and are not limiting. Many variations and modifications of the systems are possible and are within the scope of the invention. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims.

What is claimed is:

1. A method for killing a well bore traversing a formation, the method Comprising:

coupling a return line to a riser with a diverter spool configured to divert fluid from the return line into the well bore;

coupling a power riser to the return line at an interface positioned along the return line, wherein the return line has a first section extending from the interface to the diverter spool and a second section extending from the interface;

pumping a heavy fluid through the return line and the diverter spool into the well bore, wherein the hydrostatic pressure of the heavy fluid injected into the well bore exceeds the pressure of fluid in the formation;

wherein pumping the heavy fluid through the return line and the diverter spool into the well bore comprises:

pumping a first fluid through the second section of the return line into the interface;

pumping a second fluid through the power riser into the interface; and injecting the second fluid into the first fluid in the interface to form the heavy fluid.

2. The method of claim 1, further comprising:

opening a shut-off valve in the return line before pumping the heavy fluid through the return line and the diverter spool into the well bore; and pumping the heavy fluid through the shut-off valve while pumping the heavy fluid through the return line and the diverter spool into the well bore.

3. The method of claim 1, wherein the second fluid has a density that is greater than a density of the first fluid.

4. The method of claim 1, further comprising:

suspending a drill string from a drilling structure through the riser into the well bore.

5. The method of claim 1, wherein the interface comprises a valve with a first fluid inlet in fluid communication with the power riser, a second fluid inlet in fluid communication with the second section of the return line, and an outlet in fluid communication with the first section of the return line.

6. The method of claim 5, further comprising:

transitioning the valve between a first position with the outlet in fluid communication with the first fluid inlet and a second position with the outlet in fluid communication with the second fluid inlet;

injecting the second fluid from the power riser through the first fluid inlet and the outlet into the first section of the return line with the valve in the first position; and injecting the first fluid from the second section of the return line through the second fluid inlet and the outlet into the first section of the return line with the valve in the second position.

7. The method of claim 6, further comprising:

continuously and repeatedly transitioning the valve between the first position and the second position.

8. The method of claim 7, further comprising creating one or more slugs of the first fluid between slugs of second fluid in the first section of the return line.

9. A method for killing a well bore traversing a formation, the method comprising:

coupling a return line to a riser with a diverter spool configured to divert fluid from the return line into the well bore;

coupling a power riser to the return line at an interface positioned along the return line;

wherein the return line has a first section extending from the interface to the diverter spool and a second section extending from the interface wherein the interface comprises a valve with a first fluid inlet in fluid communication with the power riser, a second fluid inlet in fluid communication with the second section of the return line, and an outlet in fluid communication with the first section of the return line;

pumping a heavy fluid through the return line and the diverter spool into the well bore, wherein the hydrostatic pressure of the heavy fluid injected into the well bore exceeds the pressure of fluid in the formation.

10. The method of claim 9, wherein the heavy fluid is a heavy drilling fluid pumped through the second section of the return line, the interface, and the first section of the return line to the diverter spool.

11. The method of claim 9, further comprising:

transitioning the valve between a first position with the outlet in fluid communication with the first fluid inlet and a second position with the outlet in fluid communication with the second fluid inlet;

injecting a first fluid from the power riser through the first fluid inlet and the outlet into the first section of the return line with the valve in the first position; and injecting a second fluid from the second section of the return line through the second fluid inlet and the outlet into the first section of the return line with the valve in the second position.

12. The method of claim 11, further comprising:

continuously and repeatedly transitioning the valve between the first position and the second position.

13. The method of claim 12, further comprising creating one or more slugs of the first fluid between slugs of second fluid in the first section of the return line.

14. The method of claim 9, further comprising:

opening a shut-off valve in the return line before pumping the heavy fluid through the return line and the diverter spool into the well bore; and pumping the heavy fluid through the shut-off valve while pumping the heavy fluid through the return line and the diverter spool into the well bore.

15. The method of claim 9, wherein pumping the heavy fluid through the return line and the diverter spool into the well bore comprises:

pumping a first fluid through the second section of the return line into the interface;

pumping a second fluid through the power riser into the interface; and injecting the second fluid into the first fluid in the interface to form the heavy fluid.

16. The method of claim 15, wherein the second fluid has a density that is greater than a density of the first fluid.

17. A system for killing a well bore traversing a formation, the system comprising:

a drilling riser extending from a drilling structure;

a return line;

a diverter spool coupled to the drilling riser and the return line, the diverter spool configured to provide selective fluid communication between the return line and the well bore; and a first fluid source configured to supply a first fluid through the return line and the diverter spool into the well bore;

a power riser coupled to the return line at an interface positioned along the return line, wherein the return line has a first section extending from the diverter spool to the interface and a second section extending from the interface;

a second fluid source configured to supply a second fluid through the power riser and the diverter spool into the wellbore.

18. The system of claim 17, wherein the interface comprises a valve with a first fluid inlet in fluid communication with the second section of the return line, a second fluid inlet in fluid communication with the power riser, and an outlet in fluid communication with the first section of the return line.

19. The system of claim 18, wherein the valve has a first position with the outlet in fluid communication with the first fluid inlet and a second position with the outlet in fluid communication with the second fluid inlet.

20. The system of claim 19, wherein valve is configured to continuously and repeatedly alternate between the first position and the second position.

21. The system of claim 17, wherein the first fluid is a drilling fluid and the second fluid is a fluid having a density greater than the drilling fluid.

22. The system of claim 17, further comprising a shut-off valve positioned along the return line between the diverter spool and the interface, wherein the shut-off valve has an open position allowing fluid communication between the return line and the diverter and a closed position preventing fluid communication between the return line and the diverter.

* * * * *